US009980076B1

(12) United States Patent
Pratt et al.

(10) Patent No.: US 9,980,076 B1
(45) Date of Patent: May 22, 2018

(54) AUDIO ADJUSTMENT AND PROFILE SYSTEM

(71) Applicants: AT&T INTELLECTUAL PROPERTY I, L.P., Atlanta, GA (US); AT&T Mobility II LLC, Atlanta, GA (US)

(72) Inventors: James Pratt, Round Rock, TX (US); Eric Zavesky, Austin, TX (US); Yupeng Jia, Austin, TX (US)

(73) Assignees: AT&T INTELLECTUAL PROPERTY I, L.P., Atlanta, GA (US); AT&T MOBILITY II LLC, Atlanta, GA (US)

( * ) Notice: Subject to any disclaimer, the term of this patent is extended or adjusted under 35 U.S.C. 154(b) by 0 days. days.

(21) Appl. No.: 15/438,701

(22) Filed: Feb. 21, 2017

(51) Int. Cl.
*H04R 5/02* (2006.01)
*H04S 7/00* (2006.01)

(52) U.S. Cl.
CPC ..... *H04S 7/303* (2013.01); *H04S 7/301* (2013.01); *H04S 2400/11* (2013.01); *H04S 2400/13* (2013.01)

(58) Field of Classification Search
USPC ..... 381/26, 58, 300, 303, 307, 314, 91, 92, 381/85
See application file for complete search history.

(56) References Cited

U.S. PATENT DOCUMENTS 8,472,632 B2 6/2013 Riedel et al.
8,681,997 B2 3/2014 Karaoguz
9,119,012 B2 8/2015 Ikizyan et al.
9,219,974 B2 12/2015 Ko et al.
9,232,335 B2 1/2016 Carlsson et al.
9,288,597 B2 3/2016 Carlsson et al.
9,402,145 B2 7/2016 Carlsson et al.
9,408,011 B2 8/2016 Kim et al.
9,510,089 B2 11/2016 Norris et al.
2010/0202633 A1 8/2010 Kim et al.
2011/0096941 A1 4/2011 Marzetta et al.
(Continued)

FOREIGN PATENT DOCUMENTS

EP 2599330 B1 6/2013
EP 3046341 A1 7/2016
(Continued)

OTHER PUBLICATIONS

Merchel, "SweetSpotter," sebastianmerchel.de, 2010, 3 pages.
Cecchi, et al., "An Advanced Spatial Sound Reproduction System with Listener Position Tracking," 2014 22nd European Signal Processing Conference (EUSIPCO), 2014, 5 pages.
(Continued)

*Primary Examiner* — Yosef K Laekemariam
(74) *Attorney, Agent, or Firm* — Amin, Turocy & Watson, LLP

(57) ABSTRACT

An audio adjustment and profile system is provided that can track individuals and speaker locations in an area to dynamically calibrate speakers to provide a uniform listening experience. The system can generate an acoustic model of a room and further calibrate speakers using the acoustic model. The audio adjustment and profile system can also use profile information associated with the listener to customize the listening experience based on the preference information in the profile information. The preference information can comprise mood preferences that emphasize certain frequencies and tones while limiting others.

20 Claims, 10 Drawing Sheets

(56) References Cited

U.S. PATENT DOCUMENTS

| | | | | |
|---|---|---|---|---|
| 2012/0027226 | A1 | 2/2012 | Desenberg | |
| 2013/0121515 | A1 | 5/2013 | Hooley et al. | |
| 2014/0064526 | A1 | 3/2014 | Otto et al. | |
| 2014/0314261 | A1* | 10/2014 | Selig | H04R 25/50 381/314 |
| 2014/0328505 | A1 | 11/2014 | Heinemann et al. | |
| 2015/0016615 | A1 | 1/2015 | Rodriguez | |
| 2015/0036847 | A1 | 2/2015 | Donaldson | |
| 2015/0172843 | A1 | 6/2015 | Quan | |
| 2015/0208166 | A1 | 7/2015 | Raghuvanshi et al. | |
| 2015/0334504 | A1 | 11/2015 | Donaldson | |
| 2015/0380003 | A1* | 12/2015 | Davis | H04W 4/023 700/94 |
| 2016/0134986 | A1 | 5/2016 | Liu et al. | |
| 2016/0165374 | A1 | 6/2016 | Shi et al. | |
| 2016/0302009 | A1 | 10/2016 | Saniee et al. | |
| 2016/0309246 | A1 | 10/2016 | O'keeffe | |
| 2016/0353205 | A1 | 12/2016 | Munch | |
| 2016/0353223 | A1 | 12/2016 | Freeman | |

FOREIGN PATENT DOCUMENTS

| | | | |
|---|---|---|---|
| JP | 2014093697 | A | 5/2014 |
| KR | 101525349 | B1 | 6/2015 |
| WO | 2012115303 | A1 | 8/2012 |
| WO | 2015060678 | A1 | 4/2015 |
| WO | 2016180493 | A1 | 11/2016 |

OTHER PUBLICATIONS

Merchel, et al., "Adaptive Adjustment of the "Sweet Spot" to the Listener's Position in a Stereophonic Play Back System," Chair of Communication Acoustics, Dresden University of Technology, 2010, 3 pages.

Moynihan,"How to Turn a Few Phones into a Legit Sound System," GEAR, 2015, 4 pages.

Ueda, et al., "An Open-Source Platform for Musical Room Acoustics Research." Proceedings of the 2005 International Congress and Exposition on Noise Control Engineering, 2005, 10 pages.

* cited by examiner

AUDIO ADJUSTMENT AND PROFILE SYSTEM

TECHNICAL FIELD

The disclosed subject matter relates to a dynamic audio system that can track individuals and calibrate speaker output in real time based on profile information.

BACKGROUND

Speakers are often calibrated based on a fixed environment, where the locations of the speakers and listeners are known. This fixed calibration does not take into consideration changing environments, speakers and/or listeners on the move, and individual listener preferences.

BRIEF DESCRIPTION OF THE DRAWINGS

Non-limiting and non-exhaustive embodiments of the subject disclosure are described with reference to the following figures, wherein like reference numerals refer to like parts throughout the various views unless otherwise specified.

DETAILED DESCRIPTION

Figure 1:
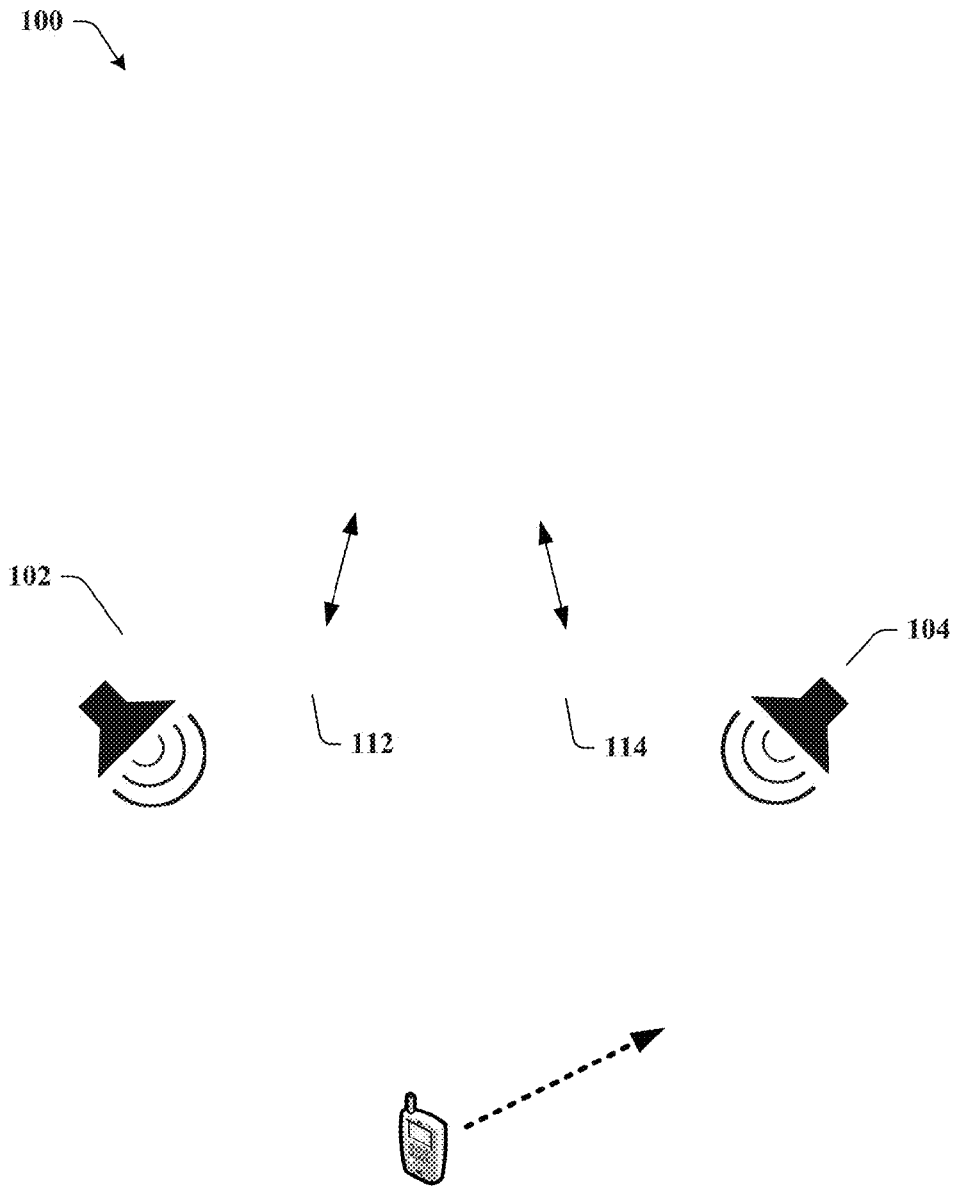
FIG. 1 illustrates an example schematic diagram of a sound profile system that can calibrate speaker output based on movement of a mobile device in accordance with various aspects and embodiments of the subject disclosure.

One or more embodiments are now described with reference to the drawings, wherein like reference numerals are used to refer to like elements throughout. In the following description, for purposes of explanation, numerous specific details are set forth in order to provide a thorough understanding of the various embodiments. It is evident, however, that the various embodiments can be practiced without these specific details (and without applying to any particular networked environment or standard).

An audio adjustment and profile system is provided that can track individuals and speaker locations in an area to dynamically calibrate speakers to provide a uniform listening experience. The system can generate an acoustic model of a room and further calibrate speakers using the acoustic model. The audio adjustment and profile system can also use profile information associated with the listener to customize the listening experience based on the preference information in the profile information. The preference information can comprise mood preferences that emphasize certain frequencies and tones while limiting others.

To at least these and related ends, a system can comprise a processor and a memory that stores executable instructions that, when executed by the processor, facilitate performance of operations, comprising generating an acoustic model for an area, wherein the acoustic model is associated with acoustic feedback and an interference, and wherein the acoustic model is generated based on a first location of a speaker in the defined area. The operations can also comprise determining a second location of a mobile device in the area. The operations can also comprise obtaining profile data representative of an audio profile of preference information of a user identity associated with the mobile device, wherein the preference information indicates a preference for an aural element of an audio playback of audio data. The operations can also comprise generating an audio signal for the speaker based on the audio profile, the first location of the speaker and the second location of the mobile device, wherein, the audio signal being rendered by the speaker is to create an aural experience at the second location that corresponds to the aural element of the audio playback.

In another embodiment, a method can comprise determining, by a device comprising a processor, a first location of a mobile device in an area. The method can also comprise determining, by the device, a second location of a speaker in the area. The method can also comprise retrieving, by the device, an audio preference profile associated with the mobile device, wherein the audio preference profile comprises information associated with a sound preference to be applied to the speaker. The method can also comprise generating, by the device, an audio signal for the speaker based on a sound recording, wherein an acoustic element of the sound recording is adjusted based on the audio preference profile, an acoustic model of the area, the first location and the second location.

In another embodiment, a machine-readable storage medium, comprising executable instructions that, when executed by a processor of a device, facilitate performance of operations. The operations can comprise determining a first location of a mobile device in an area and determining a second location of a speaker in the area. The operations can also comprise obtaining an audio preference profile associated with the mobile device, wherein the audio preference profile comprises information associated with a sound preference to be applied to sound output of the speaker. The operations can also comprise generating an audio signal for the speaker based on a sound recording, wherein an acoustic element of the sound recording is adjusted based on the audio preference profile, an acoustic model of the area, the first location and the second location.

In an embodiment, the system will enable tracking of an individual user as they move around the room and feedback that position information to system that can update sound projection. Sound projection is generally defined as methods that capitalize on audio phase, reflectance, and sensed acoustic properties of materials within an environment to correctly recreate a stereo environment for an end user.

Secondly, the system can auto calibrate for different speaker position (even non-static or moving speakers), size, and acoustic signatures. Complementing traditional calibration techniques for home theaters, this auto calibration can optimally sense and configure large spaces like movie theaters and larger venues, like stadiums for "perfect sound" everywhere. Additionally, a distributed network of speakers can be utilized where via signal processing techniques, multiple mobile devices can be utilized (e.g. any speaker that can be altered for more accurate "sound projection").

Thirdly, the system can integrate social networking concepts to audio processing, where audio sources (people, musical instruments, objects, etc) can be mapped to "concepts" that can be individually positioned by the system or profiles tracking the concepts can be generated for individuals. The term "concept" refers to every source as a separable audio source but with additional semantic connotations. For example, a source may be a piano or guitar, but the concept for these sources may be "acoustic" or "electronic". The concepts can describe both traditional acoustic properties (reverb, warmth, etc) but also imply a real-world destination or location (outside vs inside, at Niagara Falls, in Times Square, etc).

Turning now to FIG. 1, illustrated is an example schematic diagram 100 of a sound profile system 108 that can calibrate speaker output based on movement of a mobile device in accordance with various aspects and embodiments of the subject disclosure.

The sound profile system 108 can be a cloud based system that uses a Software as a Service model or similar distributed system. In other embodiments, the sound profile system 108 can be operated by a mobile network and operate off of one or more servers in the network infrastructure. In other embodiments, the sound profile system 108 can operate as an application or service on one or more mobile devices. When operating on a mobile device, the sound profile system 108 can communicate and coordinate with other mobile devices that are operating other sound profile systems. It is to be appreciated that while in FIG. 1, the sound profile system 108 is shown outside of the mobile device 106, in other embodiments, as described herein, the sound profile system 108 can operate as an application or service on mobile device 106.

In an embodiment, sound profile system 108 can determine a location of mobile device 106. The mobile device 106 location can be used as a proxy to determine a location of a user associated with the mobile device 106. The sound profile system 108 can use the location of the mobile device 106 to calibrate and/or adjust the audio signals sent to speakers 102 and 104 to provide a calibrated listening experience for the user. The sound profile system 108 can adjust the phase of the audio signals and the volume and other acoustical attributes to adjust for the relative differences in distance of the mobile device 106 from each of speakers 102 and 104.

In an embodiment, the mobile device 106 can move in the direction of arrow 110, and the sound profile system 108 can track the movement and dynamically adjust the audio signals sent to speakers 102 and 104 to compensate for the movement of mobile device 106. In an embodiment, the sound profile system 108 can adjust the audio signals sent to speakers 102 and 104 such that the aural experience at the mobile device 106 remains that same at the beginning of the playback of the audio as at the end, regardless of the movement of the mobile device 106. In other embodiments, the audio signal(s) can be adjusted so that the listening experience (perceived volume, spatial positioning of the sound, and etc) matches a predetermined criterion (e.g., that established by the user associated with mobile device 106, or established by a content creator).

In an embodiment, the sound profile system 108 can track the location of the mobile device 106 based on location information received from the mobile device 106. The mobile device 106 can send coordinates (e.g., determined via GPS on the mobile device). In other embodiments, the sound profile system 108 can determine the location of the mobile device 106 based on a location determined by a mobile network associated with the mobile device 106. In other embodiments, one or more sensors associated with the speakers 102 or 104 or other devices in an area near the mobile device 106 can track the location of the mobile device 106 within the area. For instance, if an audio playback is being performed in a room, the room can have one or more video cameras, motion sensors, IR detectors, magnetometers, NFC devices, and etc., which can track the location and movement of the mobile device 106.

In an embodiment, the sound profile system 108 can also construct an acoustic model of the area around the speakers 102 and 104. In an embodiment, the sound profile system 108 can generate a known baseline audio signal that one or more of speakers 102 or 104 can playback. Microphones 112 or 114 can pick up the acoustic sound waves that come directly from the speakers 102 and 104 as well as reflect off of the surrounding surfaces. Based on the reflections, the sound profile system 108 can generate an acoustic model of the area that can predict how acoustic signals will sound at various places in the room. In other embodiments, the sound profile system 108 can generate the acoustic model based on analysis of an image or set of images or video. Objects can be identified, the room shape can be determined, and other factors can be determine to assist in generating the acoustic model.

In an embodiment, the sound profile system 108 can generate the acoustic model based on one or both of speakers 102 and 104 playing back the baseline audio signal while microphones 112 and/or 114 are moved around the room or area. In other embodiments, the sound profile system 108 can continuously or dynamically update the acoustic model based on changing conditions in the room or area. The sound profile system 108 can continuously or periodically generate a baseline signal that can concurrently be played back by the speakers 102 and/or 104 with the main audio content, and based on changing conditions (e.g., weather, larger or smaller room, number of people in room/area, etc) the sound profile system 108 can adjust the acoustic model.

It is to be appreciated that while FIG. 1 shows two speakers, and one mobile device, in other embodiments, the sound profile system 108 can track the location of a plurality of mobile devices and adjust the audio signals to one or more speakers.

Figure 2:
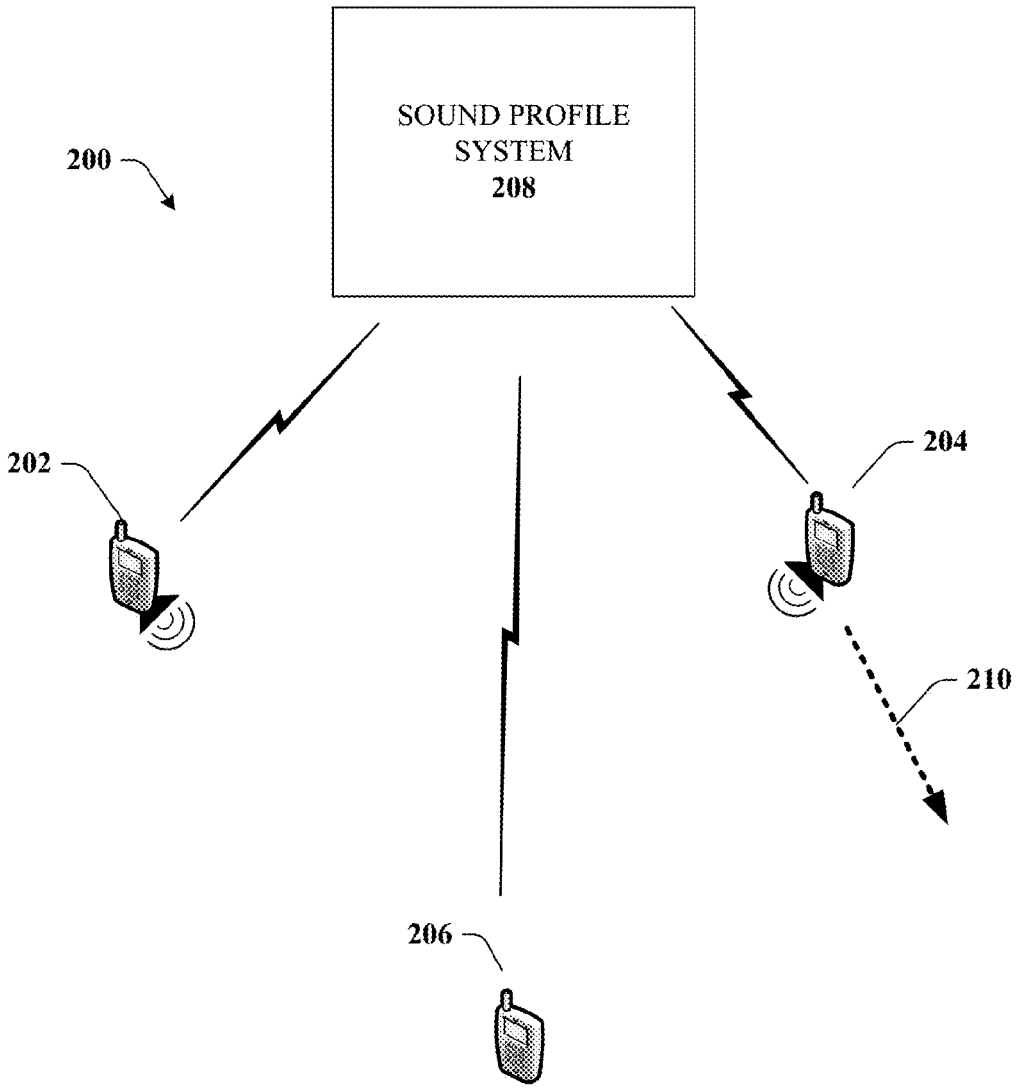
FIG. 2 illustrates an example schematic diagram of a sound profile system that can calibrate speaker output based on movement of a speaker in accordance with various aspects and embodiments of the subject disclosure.

Turning now to FIG. 2, illustrated is an example schematic diagram 200 of a sound profile system 208 that can calibrate speaker output based on movement of a speaker 204 in accordance with various aspects and embodiments of the subject disclosure.

Not only can the sound profile system 208 calibrate and adjust speakers due to the movement of a listener associated with a mobile device by tracking the movement of the mobile device, but the sound profile system 208 can also track the movement and location of a speaker 204 that moves while a mobile device 206 associated with a listener stays still (as shown in FIG. 2) or moves in other embodiments.

In the embodiment shown in FIG. 2, speakers 202 and 204 can be speakers that are part of a mobile device. The sound profile system 208 can use a distributed speaker system composed of dedicated mobile devices, or can use mobile devices associated with other users in the room or area in which the audio content is being played back. In that embodiment, the area and/or sound profile system 208 may not have dedicated speakers, but uses whatever speakers are available on mobile devices and other personal devices that are nearby. Users can opt-in on their mobile devices before the sound profile system 208 sends audio signals to the mobile devices associated with speakers 202 and 204 to play back the audio content. In other embodiments, the sound profile system 208 can have a mix of dedicated speakers not part of mobile devices, and speakers that are on mobile devices.

In an embodiment, sound profile system 208 can determine a location of speaker 202 and 204. The speakers' position can be known beforehand, or can be determined by the sound profile system 208 based on sensor information, network location information received from a mobile network, or location information received from the speakers 202 and 204. For instance, if an audio playback is being performed in a room, the room can have one or more video cameras, motion sensors, IR detectors, magnetometers, NFC devices, and etc., which can track the location and movement of the mobile device 106.

In an embodiment, the sound profile system 208 can determine that speaker 204 is moving in the direction of the arrow 210 and calibrate and/or adjust the audio signals sent to speakers 202 and 204 to provide a calibrated listening experience for the user associated with mobile device 206. The sound profile system 208 can adjust the phase of the audio signals and the volume and other acoustical attributes to adjust for the relative differences in distance of the mobile device 206 from each of speakers 202 and 204.

In an embodiment, the sound profile system 208 can adjust the audio signals sent to speakers 202 and 204 such that the aural experience at the mobile device 206 remains that same at the beginning of the playback of the audio as at the end, regardless of the movement of speaker 204. In other embodiments, the audio signal(s) can be adjusted so that the listening experience (perceived volume, spatial positioning of the sound, and etc) matches a predetermined criterion (e.g., that established by the user associated with mobile device 206, or established by a content creator).

Figure 3:
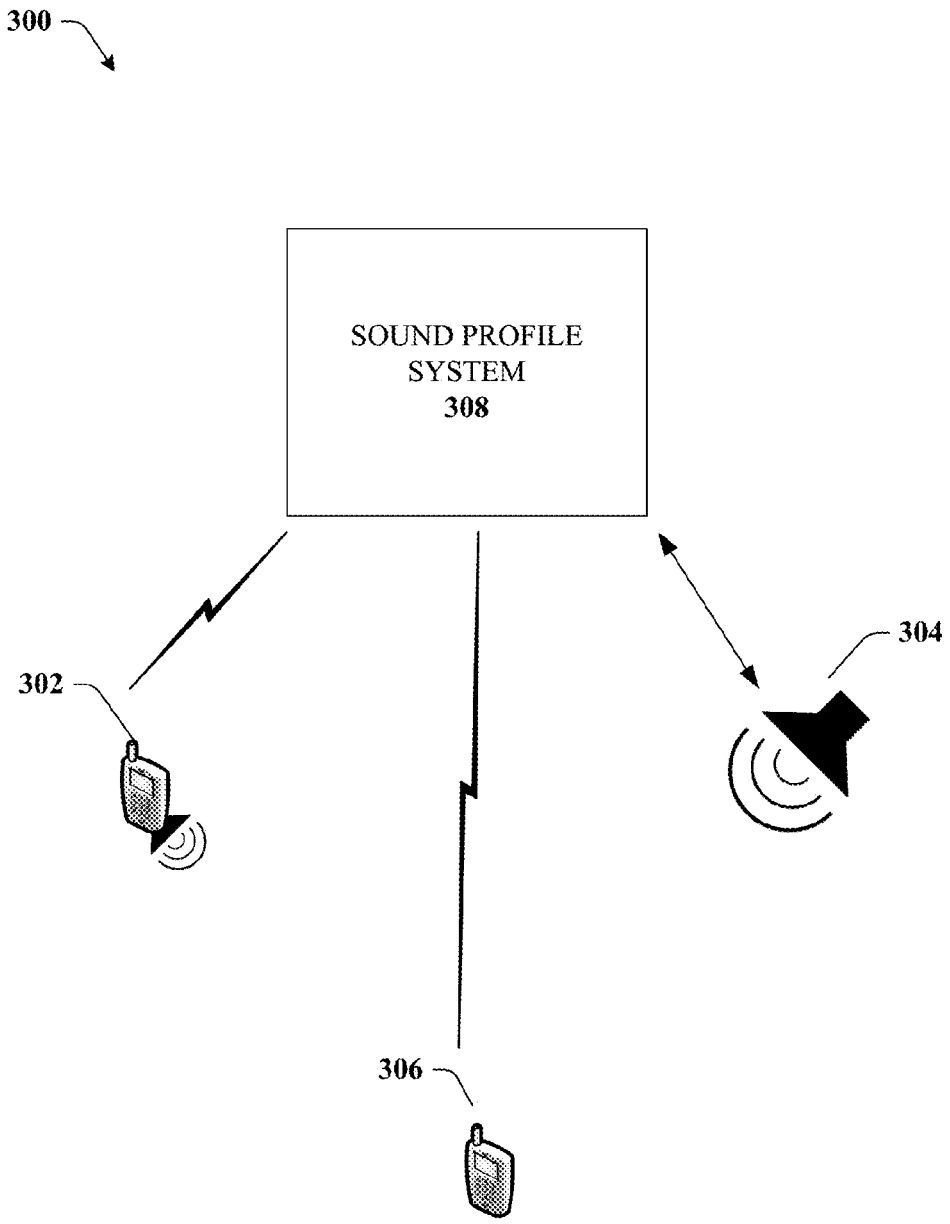
FIG. 3 illustrates an example schematic diagram of a sound profile system that can calibrate speaker output based on incorporating nearby speakers in accordance with various aspects and embodiments of the subject disclosure.

Turning now to FIG. 3, illustrated is an example schematic diagram 300 of a sound profile system 308 that can calibrate speaker output based on incorporating nearby speakers in accordance with various aspects and embodiments of the subject disclosure.

As discussed above, the sound profile system 308 may not have dedicated speakers, but uses whatever speakers are available on mobile devices and other personal devices that are nearby. Users can opt-in on their mobile devices before the sound profile system 308 sends audio signals to the speakers. In the embodiment shown in FIG. 3, speaker 302 can be on a mobile device, while speaker 304 can be a standalone speaker, dedicated or not, and mobile or fixed. Sound profile system 308, rather than sending the same audio signal to each of speakers 302 and 304, which may result in a discordant sound, sound profile system 308 can modulate the phase, pitch, timbre, volume, etc in order to match the acoustic output of speakers 302 and 304 as much as possible. The audio signals can be further modulated based on the relative distance of mobile device 306 (associated with a listener) and the speakers 302 and 304 and further modulated based on the acoustic model of the area generated by the sound profile system 308.

Figure 4:
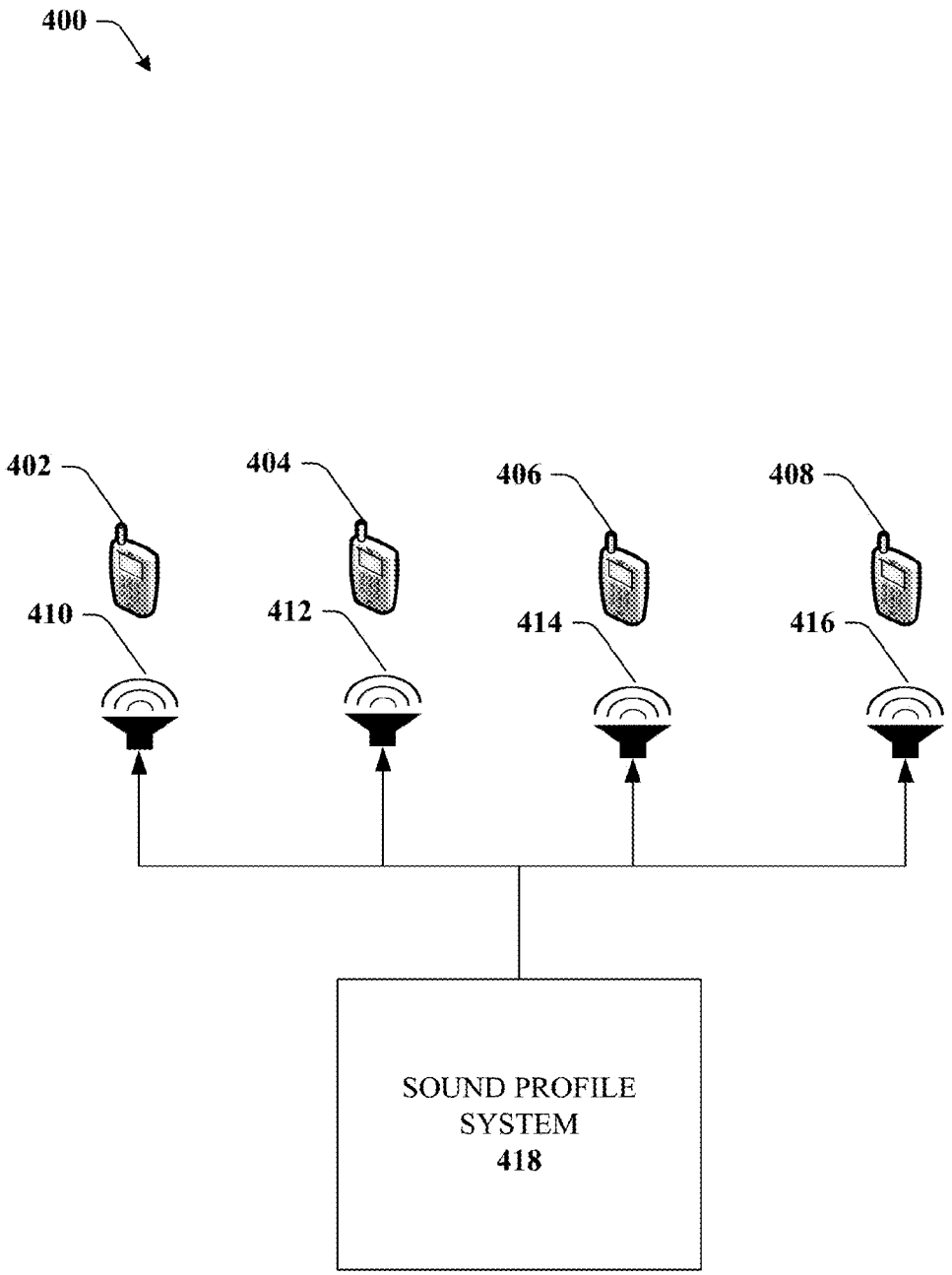
FIG. 4 illustrates an example schematic diagram of a sound profile system that can provide individualized audio playback based on profile information in accordance with various aspects and embodiments of the subject disclosure.

Turning now to FIG. 4, illustrated is an example schematic diagram 400 of a sound profile system 418 that can provide individualized audio playback based on profile information in accordance with various aspects and embodiments of the subject disclosure.

In an embodiment, sound profile system 418 can generate signals that provide personalized audio for listeners associated with mobile devices 402, 404, 406, and 408 via speakers 410, 412, 414, and 416 respectively. Each of the mobile devices 402, 404, 406, and 408 can have associated sound profiles that contain audio preference information that sound profile system 418 can use to customize the audio output at speakers 410, 412, 414, and 416 respectively. The sound profiles can be stored on the mobile devices and be retrieved by sound profile system 418 directly via a Bluetooth, Wi-Fi or NFC connection or via the mobile network. In other embodiments, the sound profiles can be stored on a mobile network or in the cloud and be retrieved by the sound profile system 418.

The sound profiles can contain preferences relating to the pitch, timbre, volume/intensity, reverb, and etc., of audio played back. The sound profile system 418 can thus modulate an audio signal associated with the audio content and generate personalized audio signals for each of speakers 410, 412, 414, and 416.

The sound profiles can also contain preferences relating to one or more filters that may further adjust the audio signal beyond the physical characteristics relating to frequency and intensity. The filters can relate to one or more effects that can affect the mood or other attribute of the audio. For instance, a listener associated with mobile device 402 may prefer music or audio to sound like warmer, and so the sound profile system 418 can apply a filter to adjust the audio signal based on the preferences. Likewise, a listener associated with mobile device 404 can prefer to have amplified voices relative to sound effects or music, and so sound profile system 418 can isolate vocal sources in the audio and increase the intensity of those sources to provide amplified vocal sounds in the audio signal sent to speaker 412.

The sound profile system 418 can identify sources and apply concepts to the sources. Sources can be the source of the audio content in the audio signal. For instance, if the audio content is a song by a band, each of the instruments in the song can be a separate source. The term "concept" refers to every source as a separable audio source but with additional semantic connotations. For example, a source may be a piano or guitar, but the concept for these sources may be "acoustic" or "electronic". The concepts can describe both traditional acoustic properties (reverb, warmth, etc) but also imply a real-world destination or location (outside vs inside, at Niagara Falls, in Times Square, etc). Usage information of concepts (favorite concept, how many audio sources possessed this concept, etc) can be pooled into user profiles and preferences where these profiles will alter future sounds played through the system. For example, certain individuals may need frequency boosting in a certain range for hearing impairments while others may prefer a softer, more reverberant tone—both of which could be applied to audio, regardless of the original creator's capture environment.

Figure 5:
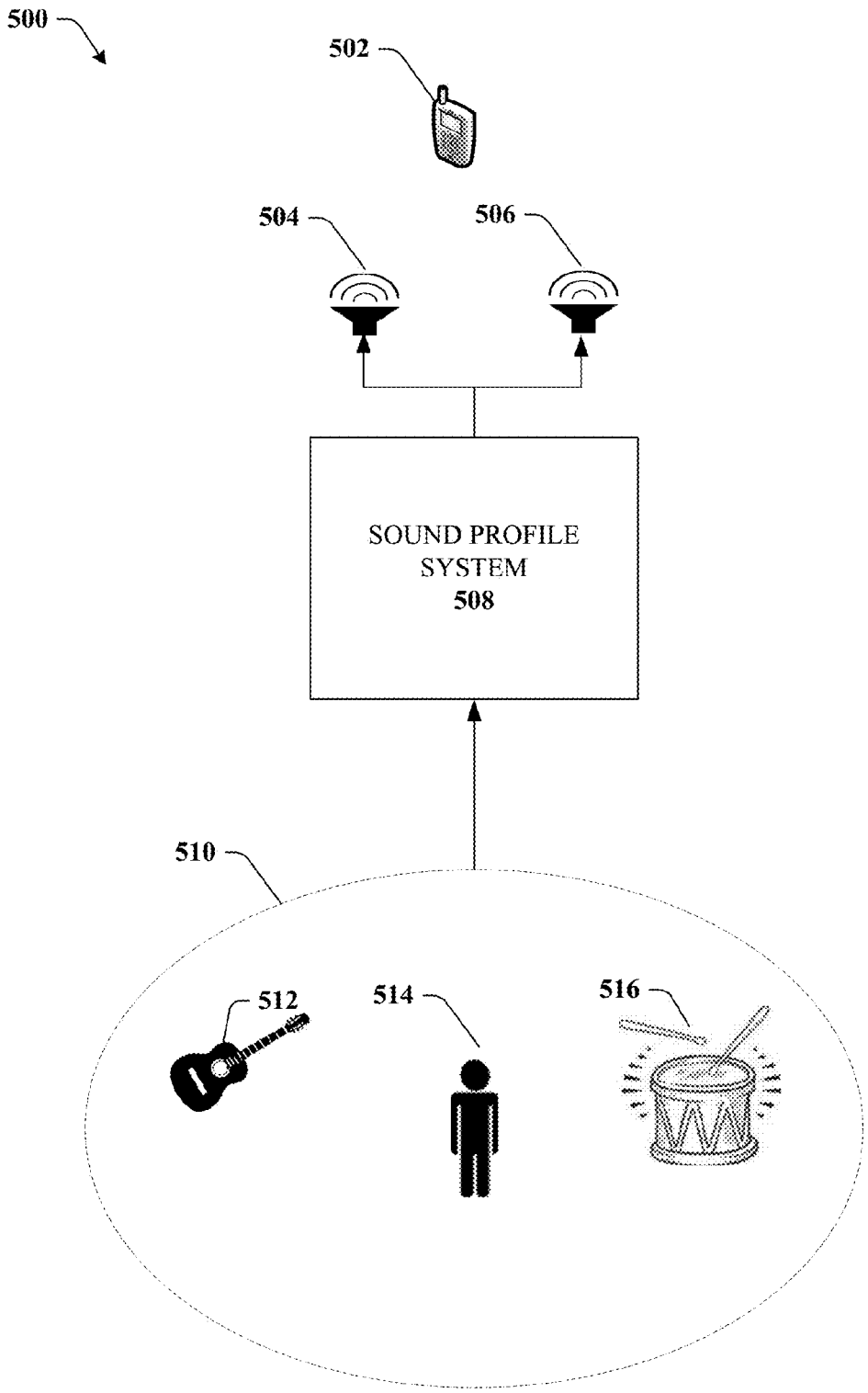
FIG. 5 illustrates an example schematic diagram of a sound profile system that can provide individualized audio playback based on profile information in accordance with various aspects and embodiments of the subject disclosure.

Turning now to FIG. 5, illustrated is an example schematic diagram 500 of a sound profile system 508 that can provide individualized audio playback based on profile information in accordance with various aspects and embodiments of the subject disclosure.

In an embodiment, sound profile system 508 can playback audio associated with a virtual reality or augmented reality experience 510. The user 514 of the virtual reality experience 510 can have a mobile device 502 that has an associated sound profile. When playing back audio from the virtual reality experience 510 via speakers 504 and 506, the sound profile system 508 can adjust or modulate the audio signals sent to the speakers 504 and 506 based on the sound profile.

In an embodiment, there can be several sound sources in the virtual reality experience 510, comprising, in an embodiment, a guitar 512 and a drum set 516. The relative volumes and other acoustic signature parameters can be set in the audio signal, but the sound profile system 508 can adjust the audio signal to boost the volume of one or more of the sources based on the preference information in the sound profile associated with the mobile device 502.

Furthermore, the position of the sound sources 512 and 516 in the virtual reality experience 510 relative to the listener 514 can be simulated by adjusting the phase, volume, and pitch relationships of the sources in the audio signals sent to speakers 504 and 506 such that the listener 514 associated with mobile device 502 hears the sources coming from positions and locations in the real world similar to that experienced in the virtual reality or augmented reality experience 510.

Figure 6:
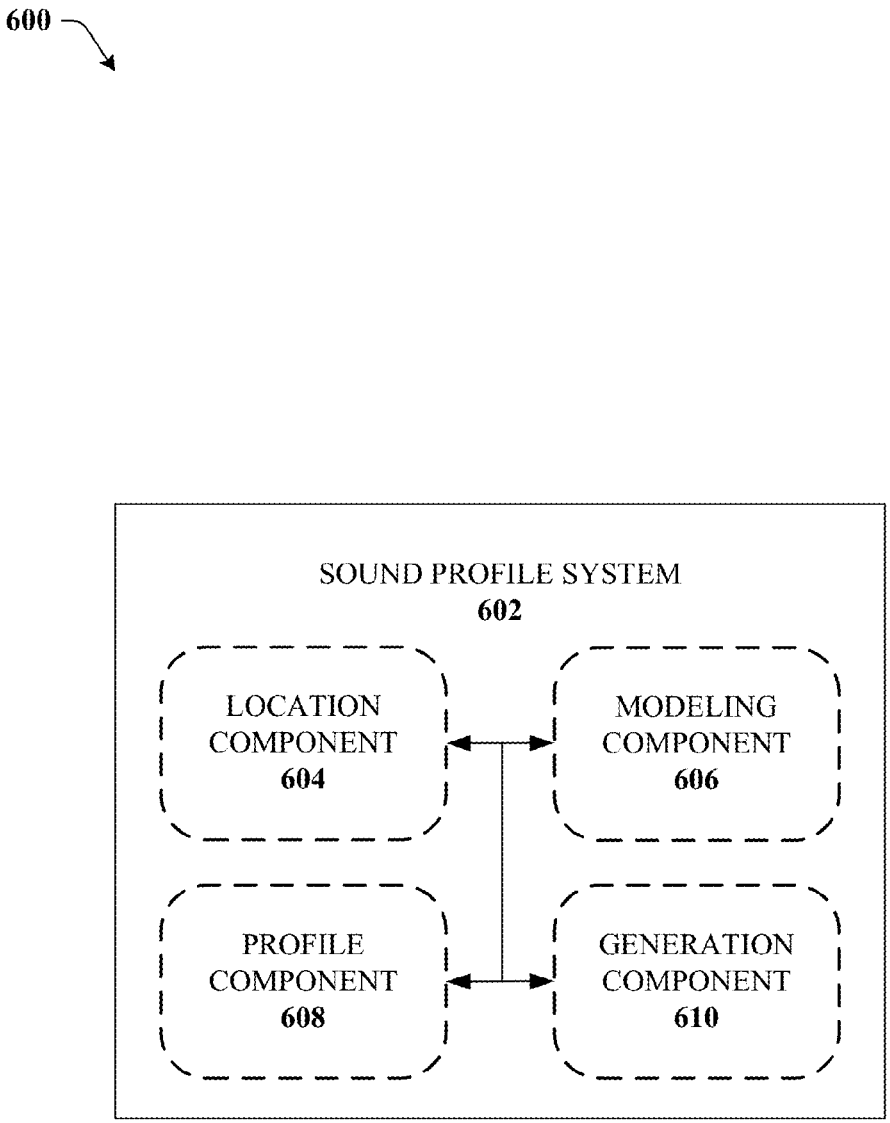
FIG. 6 illustrates an example schematic diagram of a sound profile system in accordance with various aspects and embodiments of the subject disclosure.

Turning now to FIG. 6, illustrated is an example schematic diagram 600 of a sound profile system 602 in accordance with various aspects and embodiments of the subject disclosure.

In an embodiment, a modeling component 606 can be included that can generate an acoustic model for an area, wherein the acoustic model is associated with acoustic feedback and an interference, and wherein the acoustic model is generated based on a first location of a speaker in the defined area. A location component 604 can included to determine the location of the speaker, as well as determining a location of a mobile device in the area.

A profile component 608 can be present to obtain profile data representative of an audio profile of preference information of a user identity associated with the mobile device, wherein the preference information indicates a preference for an aural element of an audio playback of audio data. A generation component 610 can be present to generate an audio signal for the speaker based on the audio profile, the first location of the speaker and the second location of the mobile device, wherein, the audio signal being rendered by the speaker is to create an aural experience at the second location that corresponds to the aural element of the audio playback.

In an embodiment, the modeling component 606 can generate a baseline audio signal that one or more speakers can playback. One or more microphones can pick up the acoustic sound waves that come directly from the speakers 102 and 104 as well as reflect off of the surrounding surfaces. Based on the reflections, the modeling component 606 can generate an acoustic model of the area that can predict how acoustic signals will sound at various places in the room. In other embodiments, the modeling component 606 can generate the acoustic model based on analysis of an image or set of images or video. Objects can be identified, the room shape can be determined, and other factors can be determine to assist in generating the acoustic model.

In an embodiment, the modeling component 606 can generate the acoustic model based on one or more speakers playing back the baseline audio signal while one or more microphones are moved around the room or area in order to map acoustic signatures are various areas in the room. In other embodiments, the modeling component 606 can continuously or dynamically update the acoustic model based on changing conditions in the room or area. The modeling component 606 can continuously or periodically generate a baseline signal that can concurrently be played back by the speakers 102 and/or 104 with the main audio content, and based on changing conditions (e.g., weather, larger or smaller room, number of people in room/area, etc) the modeling component 606 can adjust the acoustic model.

The location component 604 can track the location of one or more mobile devices based on location information received from the mobile devices. The mobile devices can send coordinates (e.g., determined via GPS on the mobile device). In other embodiments, the location component 604 can determine the location of the mobile devices based on a location determined by a mobile network associated with the mobile devices. In other embodiments, one or more sensors associated with the speakers or other devices in an area near the mobile devices can track the location of sound profile system 602 within the area. For instance, if an audio playback is being performed in a room, the room can have one or more video cameras, motion sensors, IR detectors, magnetometers, NFC devices, Wi-Fi antennas, and etc., which can track the location and movement of the mobile devices.

The profile component 608 can determine preference data from a sound profile associated with the mobile devices. The sound profiles can contain preferences relating to the pitch, timbre, volume/intensity, reverb, and etc., of audio played back. The generation component 610 can thus modulate an audio signal associated with the audio content and generate personalized audio signals for each speaker.

The sound profiles can also contain preferences relating to one or more filters that may further adjust the audio signal beyond the physical characteristics relating to frequency and intensity. The filters can relate to one or more effects that can affect the mood or other attribute of the audio. For instance, a listener associated may prefer music or audio to sound like warmer, and so the profile component 608 can apply a filter to adjust the audio signal based on the preferences. Likewise, a listener can prefer to have amplified voices relative to sound effects or music, and so profile component 608 can isolate vocal sources in the audio and increase the intensity of those sources to provide amplified vocal sounds in the audio signal sent to speaker.

The profile component 608 can identify sources and apply concepts to the sources. Sources can be the source of the audio content in the audio signal. For instance, if the audio content is a song by a band, each of the instruments in the song can be a separate source. The term "concept" refers to every source as a separable audio source but with additional semantic connotations. For example, a source may be a piano or guitar, but the concept for these sources may be "acoustic" or "electronic". The concepts can describe both traditional acoustic properties (reverb, warmth, etc) but also imply a real-world destination or location (outside vs inside, at Niagara Falls, in Times Square, etc). Usage information of concepts (favorite concept, how many audio sources possessed this concept, etc) can be pooled into user profiles and preferences where these profiles will alter future sounds played through the system. For example, certain individuals may need frequency boosting in a certain range for hearing impairments while others may prefer a softer, more reverberant tone—both of which could be applied to audio, regardless of the original creator's capture environment.

Figure 7:
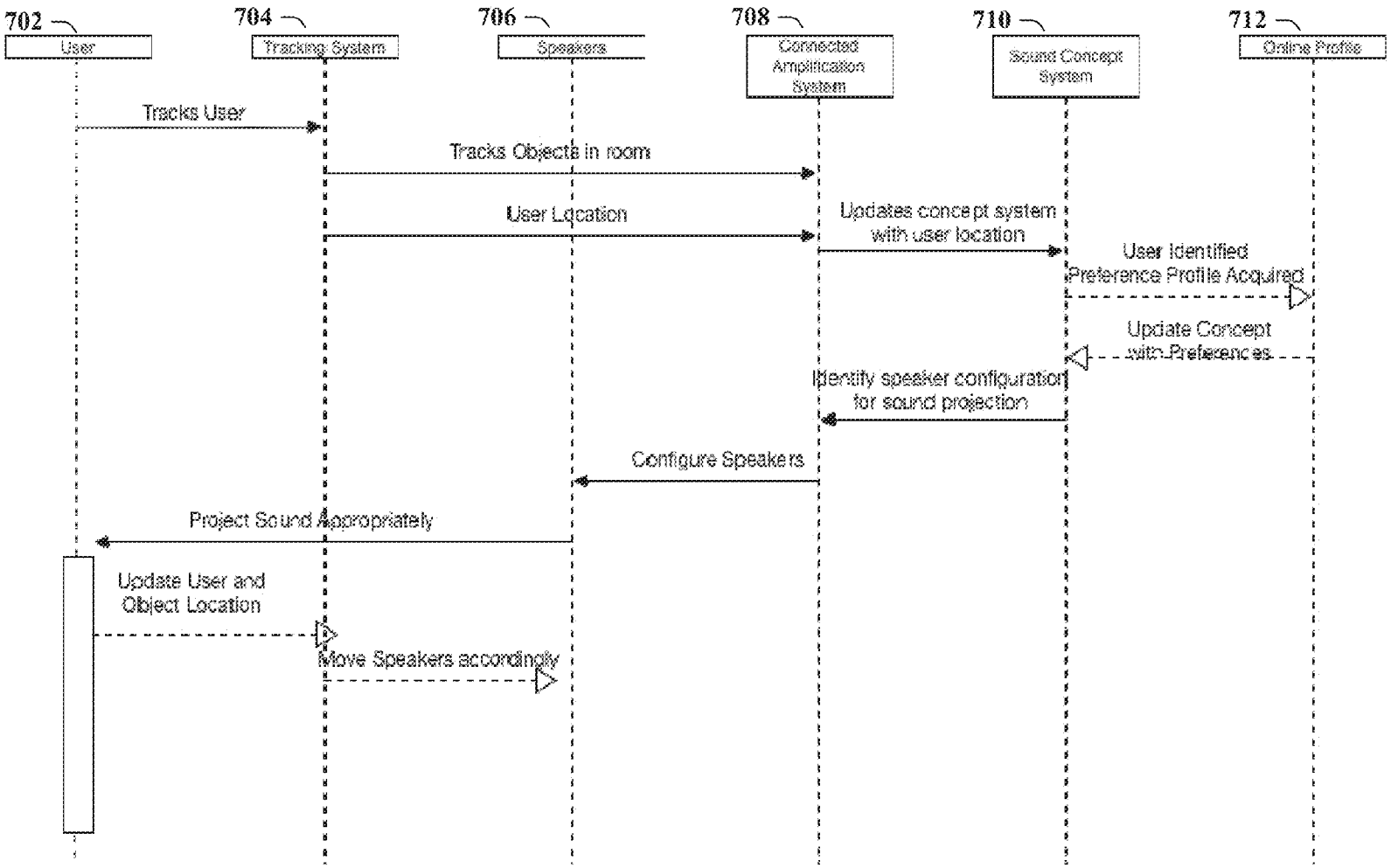
FIG. 7 illustrates an example flowchart of a sound calibration system in accordance with various aspects and embodiments of the subject disclosure.
Figure 8:
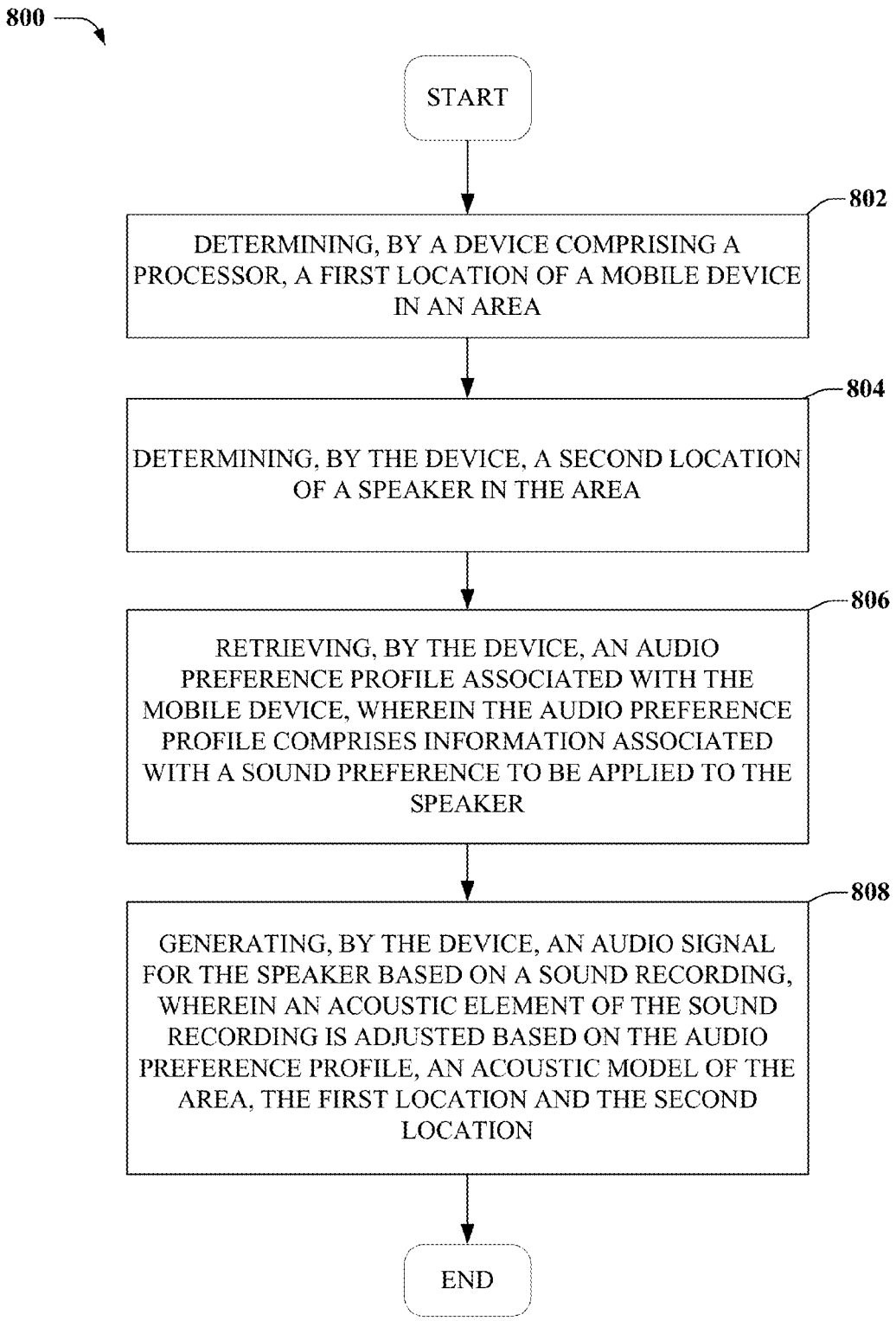
FIG. 8 illustrates an example method for a sound calibration system in accordance with various aspects and embodiments of the subject disclosure.

FIGS. 7-8 illustrates a process in connection with the aforementioned systems. The process in FIGS. 7-8 can be implemented for example by the systems in FIGS. 1-6 respectively. While for purposes of simplicity of explanation, the methods are shown and described as a series of blocks, it is to be understood and appreciated that the claimed subject matter is not limited by the order of the blocks, as some blocks may occur in different orders and/or concurrently with other blocks from what is depicted and described herein. Moreover, not all illustrated blocks may be required to implement the methods described hereinafter.

Turning now to FIG. 7, illustrated is an example flowchart 700 of a sound calibration system in accordance with various aspects and embodiments of the subject disclosure.

The flowchart can start with a user 702 who is tracked by a tracking system 704. The tracking system 704 can track the user via location information from a mobile device associated with the user, or via network location information from a mobile network associated with the mobile device. In other embodiments, the tracking system can employ cameras or other sensors to track the location of the user 702. The tracking system 704 can also track the user location in a room as well as tracking objects in a room via image analysis or other sensor information. The locations can be sent to a connected amplification system 708 that can update a concept (sound source e.g.,) system with the user location in accordance with a sound concept system 710.

The sound concept system 710 can retrieve profile information about the user 702 from an online profile database 712, and update the concepts with the preferences. The sound concept system 710 can then identify a speaker configuration in the room for sound projection, and based on the analysis, the connected amplification system 708 can configure the speakers 706. The speakers can project the sound accordingly based on the profile information, sound concepts, and object and user location. The tracking system 704 can update the user 702 location and object information and move the speakers 706 accordingly.

Turning now to FIG. 8, illustrated is an example method 800 for a sound calibration system in accordance with various aspects and embodiments of the subject disclosure.

The method can start at 802, where the method comprises determining, by a device comprising a processor, a first location of a mobile device in an area (e.g., by the location component 604).

At 804, the method comprises determining, by the device, a second location of a speaker in the area (e.g., by the location component 604).

At 806, the method comprises retrieving, by the device, an audio preference profile associated with the mobile device, wherein the audio preference profile comprises information associated with a sound preference to be applied to the speaker (e.g., by the profile component 608).

At 808, the method comprises generating, by the device, an audio signal for the speaker based on a sound recording, wherein an acoustic element of the sound recording is adjusted based on the audio preference profile, an acoustic model of the area, the first location and the second location (e.g., by the generation component 610).

Figure 9:
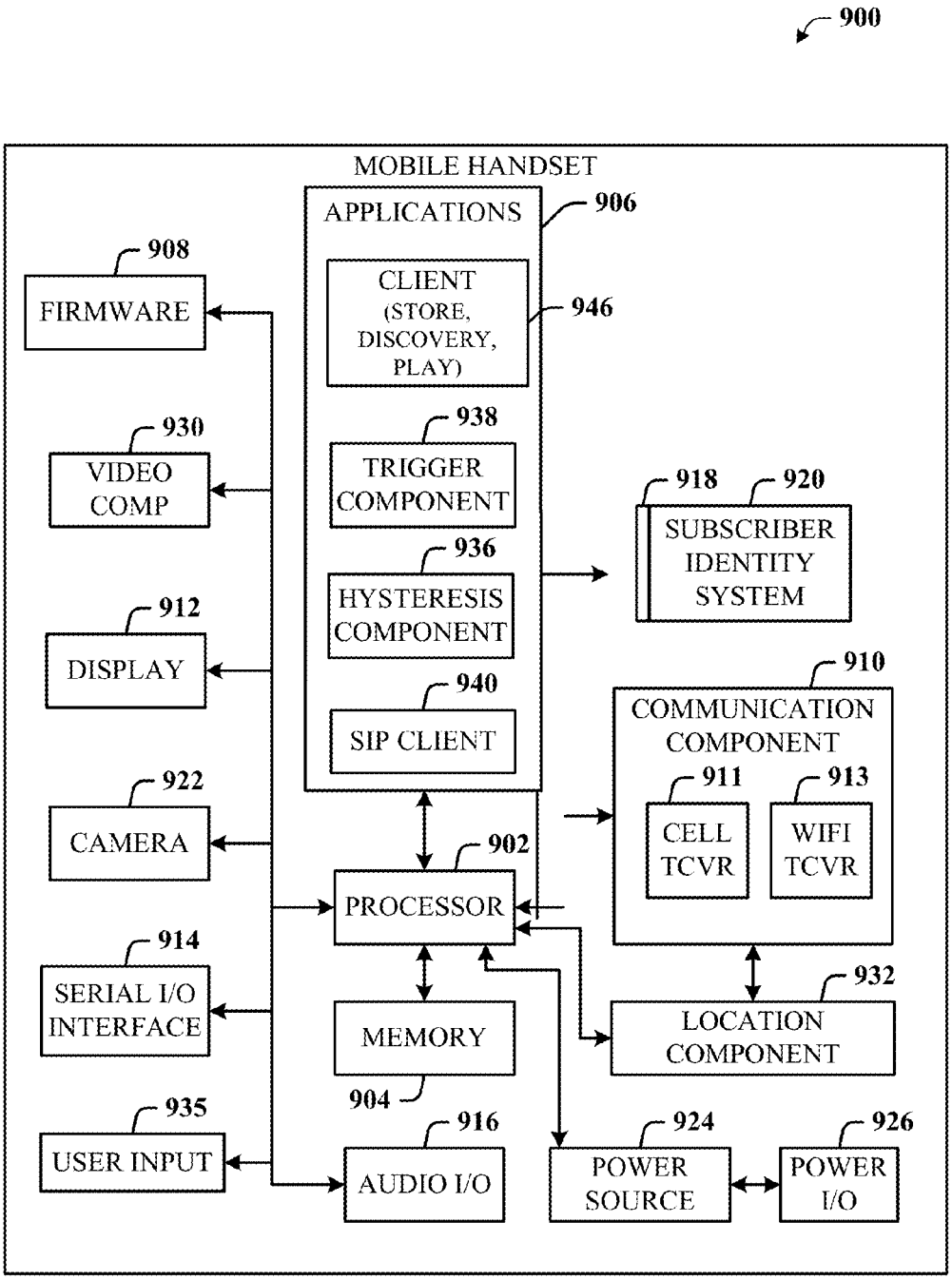
FIG. 9 illustrates an example block diagram of an example user equipment operable to provide a sound profile system in accordance with various aspects and embodiments of the subject disclosure.

Referring now to FIG. 9, illustrated is a schematic block diagram of an example end-user device such as a user equipment (e.g., mobile device 106, 206, 306, or 502) that can be a mobile device 900 capable of connecting to a network in accordance with some embodiments described herein. Although a mobile handset 900 is illustrated herein, it will be understood that other devices can be a mobile device, and that the mobile handset 900 is merely illustrated to provide context for the embodiments of the various embodiments described herein. The following discussion is intended to provide a brief, general description of an example of a suitable environment 900 in which the various embodiments can be implemented. While the description comprises a general context of computer-executable instructions embodied on a machine-readable storage medium, those skilled in the art will recognize that the innovation also can be implemented in combination with other program modules and/or as a combination of hardware and software.

Generally, applications (e.g., program modules) can comprise routines, programs, components, data structures, etc., that perform particular tasks or implement particular abstract data types. Moreover, those skilled in the art will appreciate that the methods described herein can be practiced with other system configurations, including single-processor or multiprocessor systems, minicomputers, mainframe computers, as well as personal computers, hand-held computing devices, microprocessor-based or programmable consumer electronics, and the like, each of which can be operatively coupled to one or more associated devices.

A computing device can typically comprise a variety of machine-readable media. Machine-readable media can be any available media that can be accessed by the computer and comprises both volatile and non-volatile media, removable and non-removable media. By way of example and not limitation, computer-readable media can comprise computer storage media and communication media. Computer storage media can comprise volatile and/or non-volatile media, removable and/or non-removable media implemented in any method or technology for storage of information, such as computer-readable instructions, data structures, program modules or other data. Computer storage media can comprise, but is not limited to, RAM, ROM, EEPROM, flash memory or other memory technology, CD ROM, digital video disk (DVD) or other optical disk storage, magnetic cassettes, magnetic tape, magnetic disk storage or other magnetic storage devices, or any other medium which can be used to store the desired information and which can be accessed by the computer.

Communication media typically embodies computer-readable instructions, data structures, program modules or other data in a modulated data signal such as a carrier wave or other transport mechanism, and comprises any information delivery media. The term "modulated data signal" means a signal that has one or more of its characteristics set or changed in such a manner as to encode information in the signal. By way of example, and not limitation, communication media comprises wired media such as a wired network or direct-wired connection, and wireless media such as acoustic, RF, infrared and other wireless media. Combinations of the any of the above should also be comprised within the scope of computer-readable media.

The handset 900 comprises a processor 902 for controlling and processing all onboard operations and functions. A memory 904 interfaces to the processor 902 for storage of data and one or more applications 906 (e.g., a video player software, user feedback component software, etc.). Other applications can comprise voice recognition of predetermined voice commands that facilitate initiation of the user feedback signals. The applications 906 can be stored in the memory 904 and/or in a firmware 908, and executed by the processor 902 from either or both the memory 904 or/and the firmware 908. The firmware 908 can also store startup code for execution in initializing the handset 900. A communications component 910 interfaces to the processor 902 to facilitate wired/wireless communication with external systems, e.g., cellular networks, VoIP networks, and so on. Here, the communications component 910 can also comprise a suitable cellular transceiver 911 (e.g., a GSM transceiver) and/or an unlicensed transceiver 913 (e.g., Wi-Fi, WiMax) for corresponding signal communications. The handset 900 can be a device such as a cellular telephone, a PDA with mobile communications capabilities, and messaging-centric devices. The communications component 910 also facilitates communications reception from terrestrial radio networks (e.g., broadcast), digital satellite radio networks, and Internet-based radio services networks.

The handset 900 comprises a display 912 for displaying text, images, video, telephony functions (e.g., a Caller ID function), setup functions, and for user input. For example, the display 912 can also be referred to as a "screen" that can accommodate the presentation of multimedia content (e.g., music metadata, messages, wallpaper, graphics, etc.). The display 912 can also display videos and can facilitate the generation, editing and sharing of video quotes. A serial I/O interface 914 is provided in communication with the processor 902 to facilitate wired and/or wireless serial communications (e.g., USB, and/or IEEE 1394) through a hardwire connection, and other serial input devices (e.g., a keyboard, keypad, and mouse). This supports updating and troubleshooting the handset 900, for example. Audio capabilities are provided with an audio I/O component 916, which can comprise a speaker for the output of audio signals related to, for example, indication that the user pressed the proper key or key combination to initiate the user feedback signal. The audio I/O component 916 also facilitates the input of audio signals through a microphone to record data and/or telephony voice data, and for inputting voice signals for telephone conversations.

The handset 900 can comprise a slot interface 918 for accommodating a SIC (Subscriber Identity Component) in the form factor of a card Subscriber Identity Module (SIM) or universal SIM 920, and interfacing the SIM card 920 with the processor 902. However, it is to be appreciated that the SIM card 920 can be manufactured into the handset 900, and updated by downloading data and software.

The handset 900 can process IP data traffic through the communication component 910 to accommodate IP traffic from an IP network such as, for example, the Internet, a corporate intranet, a home network, a person area network, etc., through an ISP or broadband cable provider. Thus, VoIP traffic can be utilized by the handset 800 and IP-based multimedia content can be received in either an encoded or decoded format.

A video processing component 922 (e.g., a camera) can be provided for decoding encoded multimedia content. The video processing component 922 can aid in facilitating the generation, editing and sharing of video quotes. The handset 900 also comprises a power source 924 in the form of batteries and/or an AC power subsystem, which power source 924 can interface to an external power system or charging equipment (not shown) by a power I/O component 926.

The handset 900 can also comprise a video component 930 for processing video content received and, for recording and transmitting video content. For example, the video component 930 can facilitate the generation, editing and sharing of video quotes. A location tracking component 932 facilitates geographically locating the handset 900. As described hereinabove, this can occur when the user initiates the feedback signal automatically or manually. A user input component 934 facilitates the user initiating the quality feedback signal. The user input component 934 can also facilitate the generation, editing and sharing of video quotes. The user input component 934 can comprise such conventional input device technologies such as a keypad, keyboard, mouse, stylus pen, and/or touch screen, for example.

Referring again to the applications 906, a hysteresis component 936 facilitates the analysis and processing of hysteresis data, which is utilized to determine when to associate with the access point. A software trigger component 938 can be provided that facilitates triggering of the hysteresis component 938 when the Wi-Fi transceiver 913 detects the beacon of the access point. A SIP client 940 enables the handset 900 to support SIP protocols and register the subscriber with the SIP registrar server. The applications 906 can also comprise a client 942 that provides at least the capability of discovery, play and store of multimedia content, for example, music.

The handset 900 can comprise an indoor network radio transceiver 913 (e.g., Wi-Fi transceiver). This function supports the indoor radio link, such as IEEE 802.11, for the dual-mode GSM handset 900. The handset 900 can accommodate at least satellite radio services through a handset that can combine wireless voice and digital radio chipsets into a single handheld device.

Figure 10:
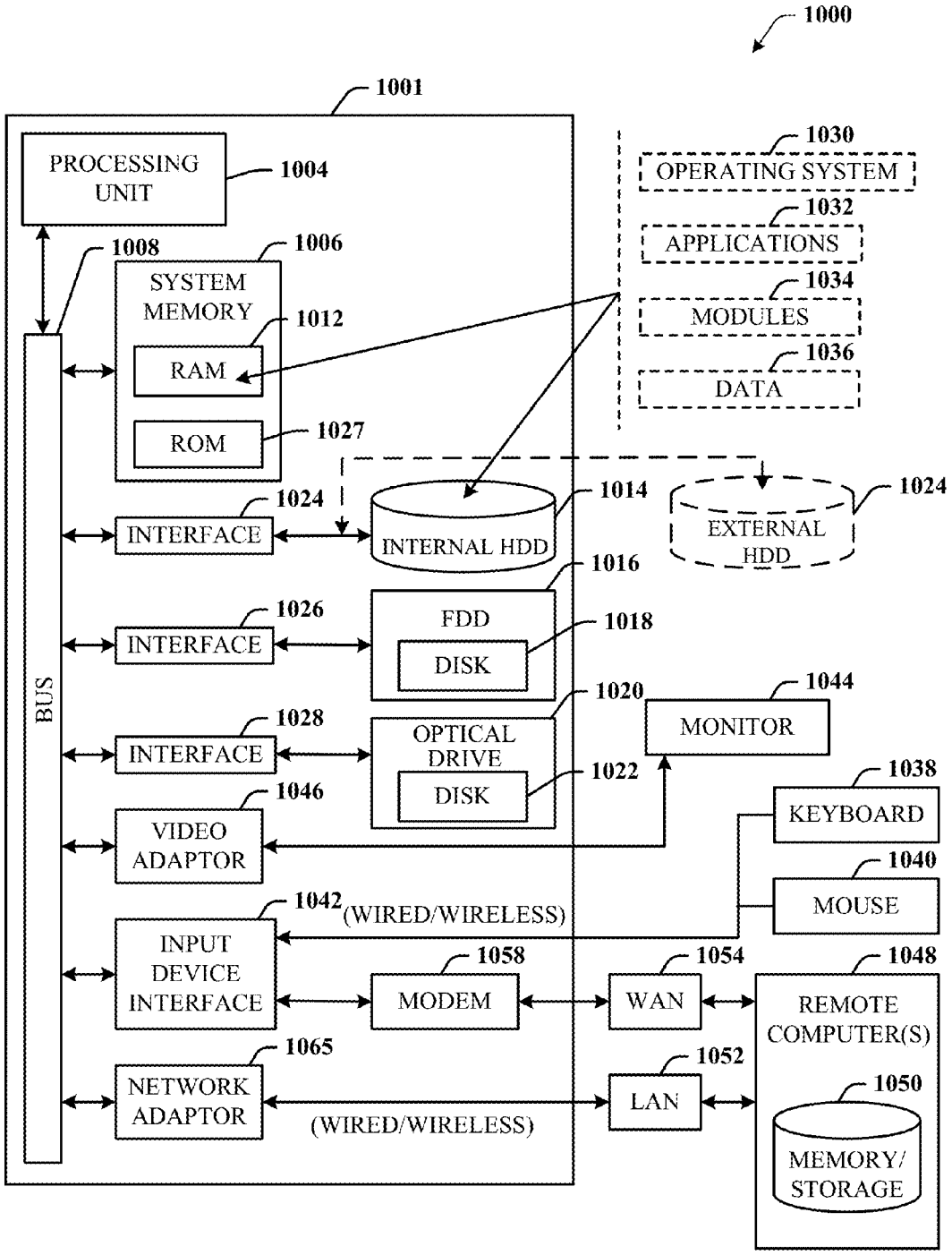
FIG. 10 illustrates an example block diagram of a computer that can be operable to execute processes and methods in accordance with various aspects and embodiments of the subject disclosure.

Referring now to FIG. 10, there is illustrated a block diagram of a computer 1000 operable to execute the functions and operations performed in the described example embodiments. For example, a cloud component or service (e.g., sound profile system described herein) may contain components as described in FIG. 10. The computer 1000 can provide networking and communication capabilities between a wired or wireless communication network and a server and/or communication device. In order to provide additional context for various aspects thereof, FIG. 10 and the following discussion are intended to provide a brief, general description of a suitable computing environment in which the various aspects of the innovation can be implemented to facilitate the establishment of a transaction between an entity and a third party. While the description above is in the general context of computer-executable instructions that can run on one or more computers, those skilled in the art will recognize that the innovation also can be implemented in combination with other program modules and/or as a combination of hardware and software.

Generally, program modules comprise routines, programs, components, data structures, etc., that perform particular tasks or implement particular abstract data types. Moreover, those skilled in the art will appreciate that the inventive methods can be practiced with other computer system configurations, including single-processor or multiprocessor computer systems, minicomputers, mainframe computers, as well as personal computers, hand-held computing devices, microprocessor-based or programmable consumer electronics, and the like, each of which can be operatively coupled to one or more associated devices.

The illustrated aspects of the innovation can also be practiced in distributed computing environments where certain tasks are performed by remote processing devices that are linked through a communications network. In a distributed computing environment, program modules can be located in both local and remote memory storage devices.

Computing devices typically comprise a variety of media, which can comprise computer-readable storage media or communications media, which two terms are used herein differently from one another as follows.

Computer-readable storage media can be any available storage media that can be accessed by the computer and comprises both volatile and nonvolatile media, removable and non-removable media. By way of example, and not limitation, computer-readable storage media can be implemented in connection with any method or technology for storage of information such as computer-readable instructions, program modules, structured data, or unstructured data. Computer-readable storage media can comprise, but are not limited to, RAM, ROM, EEPROM, flash memory or other memory technology, CD-ROM, digital versatile disk (DVD) or other optical disk storage, magnetic cassettes, magnetic tape, magnetic disk storage or other magnetic storage devices, or other tangible and/or non-transitory media which can be used to store desired information. Computer-readable storage media can be accessed by one or more local or remote computing devices, e.g., via access requests, queries or other data retrieval protocols, for a variety of operations with respect to the information stored by the medium.

Communications media can embody computer-readable instructions, data structures, program modules or other structured or unstructured data in a data signal such as a modulated data signal, e.g., a carrier wave or other transport mechanism, and comprises any information delivery or transport media. The term "modulated data signal" or signals refers to a signal that has one or more of its characteristics set or changed in such a manner as to encode information in one or more signals. By way of example, and not limitation, communication media comprise wired media, such as a wired network or direct-wired connection, and wireless media such as acoustic, RF, infrared and other wireless media.

With reference to FIG. 10, implementing various aspects described herein with regards to the end-user device can comprise a computer 1000, the computer 1000 including a processing unit 1004, a system memory 1006 and a system bus 1008. The system bus 1008 couples system components including, but not limited to, the system memory 1006 to the processing unit 1004. The processing unit 1004 can be any of various commercially available processors. Dual microprocessors and other multi-processor architectures can also be employed as the processing unit 1004.

The system bus 1008 can be any of several types of bus structure that can further interconnect to a memory bus (with or without a memory controller), a peripheral bus, and a local bus using any of a variety of commercially available bus architectures. The system memory 1006 comprises read-only memory (ROM) 1027 and random access memory (RAM) 1012. A basic input/output system (BIOS) is stored in a non-volatile memory 1027 such as ROM, EPROM, EEPROM, which BIOS contains the basic routines that help to transfer information between elements within the computer 1000, such as during start-up. The RAM 1012 can also comprise a high-speed RAM such as static RAM for caching data.

The computer 1000 further comprises an internal hard disk drive (HDD) 1014 (e.g., EIDE, SATA), which internal hard disk drive 1014 can also be configured for external use in a suitable chassis (not shown), a magnetic floppy disk drive (FDD) 1016, (e.g., to read from or write to a removable diskette 1018) and an optical disk drive 1020, (e.g., reading a CD-ROM disk 1022 or, to read from or write to other high capacity optical media such as the DVD). The hard disk drive 1014, magnetic disk drive 1016 and optical disk drive 1020 can be connected to the system bus 1008 by a hard disk drive interface 1024, a magnetic disk drive interface 1026 and an optical drive interface 1028, respectively. The interface 1024 for external drive implementations comprises at least one or both of Universal Serial Bus (USB) and IEEE 1394 interface technologies. Other external drive connection technologies are within contemplation of the subject innovation.

The drives and their associated computer-readable media provide nonvolatile storage of data, data structures, computer-executable instructions, and so forth. For the computer 1000 the drives and media accommodate the storage of any data in a suitable digital format. Although the description of computer-readable media above refers to a HDD, a removable magnetic diskette, and a removable optical media such as a CD or DVD, it should be appreciated by those skilled in the art that other types of media which are readable by a computer 1000, such as zip drives, magnetic cassettes, flash memory cards, cartridges, and the like, can also be used in the example operating environment, and further, that any such media can contain computer-executable instructions for performing the methods of the disclosed innovation.

A number of program modules can be stored in the drives and RAM 1012, including an operating system 1030, one or more application programs 1032, other program modules 1034 and program data 1036. All or portions of the operating system, applications, modules, and/or data can also be cached in the RAM 1012. It is to be appreciated that the innovation can be implemented with various commercially available operating systems or combinations of operating systems.

A user can enter commands and information into the computer 1000 through one or more wired/wireless input devices, e.g., a keyboard 1038 and a pointing device, such as a mouse 1040. Other input devices (not shown) may comprise a microphone, an IR remote control, a joystick, a game pad, a stylus pen, touch screen, or the like. These and other input devices are often connected to the processing unit 1004 through an input device interface 1042 that is coupled to the system bus 1008, but can be connected by other interfaces, such as a parallel port, an IEEE 1394 serial port, a game port, a USB port, an IR interface, etc.

A monitor 1044 or other type of display device is also connected to the system bus 1008 through an interface, such as a video adapter 1046. In addition to the monitor 1044, a computer 1000 typically comprises other peripheral output devices (not shown), such as speakers, printers, etc.

The computer 1000 can operate in a networked environment using logical connections by wired and/or wireless communications to one or more remote computers, such as a remote computer(s) 1048. The remote computer(s) 1048 can be a workstation, a server computer, a router, a personal computer, portable computer, microprocessor-based entertainment device, a peer device or other common network node, and typically comprises many or all of the elements described relative to the computer, although, for purposes of brevity, only a memory/storage device 1050 is illustrated. The logical connections depicted comprise wired/wireless connectivity to a local area network (LAN) 1052 and/or larger networks, e.g., a wide area network (WAN) 1054. Such LAN and WAN networking environments are commonplace in offices and companies, and facilitate enterprise-wide computer networks, such as intranets, all of which may connect to a global communications network, e.g., the Internet.

When used in a LAN networking environment, the computer 1000 is connected to the local network 1052 through a wired and/or wireless communication network interface or adapter 1056. The adapter 1056 may facilitate wired or wireless communication to the LAN 1052, which may also comprise a wireless access point disposed thereon for communicating with the wireless adapter 1056.

When used in a WAN networking environment, the computer 1000 can comprise a modem 1058, or is connected to a communications server on the WAN 1054, or has other means for establishing communications over the WAN 1054, such as by way of the Internet. The modem 1058, which can be internal or external and a wired or wireless device, is connected to the system bus 1008 through the input device interface 1042. In a networked environment, program modules depicted relative to the computer, or portions thereof, can be stored in the remote memory/storage device 1050. It will be appreciated that the network connections shown are exemplary and other means of establishing a communications link between the computers can be used.

The computer is operable to communicate with any wireless devices or entities operatively disposed in wireless communication, e.g., a printer, scanner, desktop and/or portable computer, portable data assistant, communications satellite, any piece of equipment or location associated with a wirelessly detectable tag (e.g., a kiosk, news stand, restroom), and telephone. This comprises at least Wi-Fi and Bluetooth™ wireless technologies. Thus, the communication can be a predefined structure as with a conventional network or simply an ad hoc communication between at least two devices.

Wi-Fi, or Wireless Fidelity, allows connection to the Internet from a couch at home, a bed in a hotel room, or a conference room at work, without wires. Wi-Fi is a wireless technology similar to that used in a cell phone that enables such devices, e.g., computers, to send and receive data indoors and out; anywhere within the range of a base station. Wi-Fi networks use radio technologies called IEEE802.11 (a, b, g, n, etc.) to provide secure, reliable, fast wireless connectivity. A Wi-Fi network can be used to connect computers to each other, to the Internet, and to wired networks (which use IEEE802.3 or Ethernet). Wi-Fi networks operate in the unlicensed 2.4 and 5 GHz radio bands, at an 11 Mbps (802.11b) or 54 Mbps (802.11a) data rate, for example, or with products that contain both bands (dual band), so the networks can provide real-world performance similar to the basic "10BaseT" wired Ethernet networks used in many offices.

As used in this application, the terms "system," "component," "interface," and the like are generally intended to refer to a computer-related entity or an entity related to an operational machine with one or more specific functionalities. The entities disclosed herein can be either hardware, a combination of hardware and software, software, or software in execution. For example, a component may be, but is not limited to being, a process running on a processor, a processor, an object, an executable, a thread of execution, a program, and/or a computer. By way of illustration, both an application running on a server and the server can be a component. One or more components may reside within a process and/or thread of execution and a component may be localized on one computer and/or distributed between two or more computers. These components also can execute from various computer readable storage media having various data structures stored thereon. The components may communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry that is operated by software or firmware application(s) executed by a processor, wherein the processor can be internal or external to the apparatus and executes at least a part of the software or firmware application. As yet another example, a component can be an apparatus that provides specific functionality through electronic components without mechanical parts, the electronic components can comprise a processor therein to execute software or firmware that confers at least in part the functionality of the electronic components. An interface can comprise input/output (I/O) components as well as associated processor, application, and/or API components.

Furthermore, the disclosed subject matter may be implemented as a method, apparatus, or article of manufacture using standard programming and/or engineering techniques to produce software, firmware, hardware, or any combination thereof to control a computer to implement the disclosed subject matter. The term "article of manufacture" as used herein is intended to encompass a computer program accessible from any computer-readable device, computer-readable carrier, or computer-readable media. For example, computer-readable media can comprise, but are not limited to, a magnetic storage device, e.g., hard disk; floppy disk; magnetic strip(s); an optical disk (e.g., compact disk (CD), a digital video disc (DVD), a Blu-ray Disc™ (BD)); a smart card; a flash memory device (e.g., card, stick, key drive); and/or a virtual device that emulates a storage device and/or any of the above computer-readable media.

As it employed in the subject specification, the term "processor" can refer to substantially any computing processing unit or device comprising, but not limited to comprising, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Processors can exploit nano-scale architectures such as, but not limited to, molecular and quantum-dot based transistors, switches and gates, in order to optimize space usage or enhance performance of user equipment. A processor also can be implemented as a combination of computing processing units.

In the subject specification, terms such as "store," "data store," "data storage," "database," "repository," "queue", and substantially any other information storage component relevant to operation and functionality of a component, refer to "memory components," or entities embodied in a "memory" or components comprising the memory. It will be appreciated that the memory components described herein can be either volatile memory or nonvolatile memory, or can comprise both volatile and nonvolatile memory. In addition, memory components or memory elements can be removable or stationary. Moreover, memory can be internal or external to a device or component, or removable or stationary. Memory can comprise various types of media that are readable by a computer, such as hard-disc drives, zip drives, magnetic cassettes, flash memory cards or other types of memory cards, cartridges, or the like.

By way of illustration, and not limitation, nonvolatile memory can comprise read only memory (ROM), programmable ROM (PROM), electrically programmable ROM (EPROM), electrically erasable ROM (EEPROM), or flash memory. Volatile memory can comprise random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM). Additionally, the disclosed memory components of systems or methods herein are intended to comprise, without being limited to comprising, these and any other suitable types of memory.

In particular and in regard to the various functions performed by the above described components, devices, circuits, systems and the like, the terms (including a reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated example aspects of the embodiments. In this regard, it will also be recognized that the embodiments comprises a system as well as a computer-readable medium having computer-executable instructions for performing the acts and/or events of the various methods.

Computing devices typically comprise a variety of media, which can comprise computer-readable storage media and/or communications media, which two terms are used herein differently from one another as follows. Computer-readable storage media can be any available storage media that can be accessed by the computer and comprises both volatile and nonvolatile media, removable and non-removable media. By way of example, and not limitation, computer-readable storage media can be implemented in connection with any method or technology for storage of information such as computer-readable instructions, program modules, structured data, or unstructured data. Computer-readable storage media can comprise, but are not limited to, RAM, ROM, EEPROM, flash memory or other memory technology, CD-ROM, digital versatile disk (DVD) or other optical disk storage, magnetic cassettes, magnetic tape, magnetic disk storage or other magnetic storage devices, or other tangible and/or non-transitory media which can be used to store desired information. Computer-readable storage media can be accessed by one or more local or remote computing devices, e.g., via access requests, queries or other data retrieval protocols, for a variety of operations with respect to the information stored by the medium.

On the other hand, communications media typically embody computer-readable instructions, data structures, program modules or other structured or unstructured data in a data signal such as a modulated data signal, e.g., a carrier wave or other transport mechanism, and comprises any information delivery or transport media. The term "modulated data signal" or signals refers to a signal that has one or more of its characteristics set or changed in such a manner as to encode information in one or more signals. By way of example, and not limitation, communications media comprise wired media, such as a wired network or direct-wired connection, and wireless media such as acoustic, RF, infrared and other wireless media.

Further, terms like "user equipment," "user device," "mobile device," "mobile," station," "access terminal," "terminal," "handset," and similar terminology, generally refer to a wireless device utilized by a subscriber or user of a wireless communication network or service to receive or convey data, control, voice, video, sound, gaming, or substantially any data-stream or signaling-stream. The foregoing terms are utilized interchangeably in the subject specification and related drawings. Likewise, the terms "access point," "node B," "base station," "evolved Node B," "cell," "cell site," and the like, can be utilized interchangeably in the subject application, and refer to a wireless network component or appliance that serves and receives data, control, voice, video, sound, gaming, or substantially any data-stream or signaling-stream from a set of subscriber stations. Data and signaling streams can be packetized or frame-based flows. It is noted that in the subject specification and drawings, context or explicit distinction provides differentiation with respect to access points or base stations that serve and receive data from a mobile device in an outdoor environment, and access points or base stations that operate in a confined, primarily indoor environment overlaid in an outdoor coverage area. Data and signaling streams can be packetized or frame-based flows.

Furthermore, the terms "user," "subscriber," "customer," "consumer," and the like are employed interchangeably throughout the subject specification, unless context warrants particular distinction(s) among the terms. It should be appreciated that such terms can refer to human entities, associated devices, or automated components supported through artificial intelligence (e.g., a capacity to make inference based on complex mathematical formalisms) which can provide simulated vision, sound recognition and so forth. In addition, the terms "wireless network" and "network" are used interchangeable in the subject application, when context wherein the term is utilized warrants distinction for clarity purposes such distinction is made explicit.

Moreover, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

In addition, while a particular feature may have been disclosed with respect to only one of several implementations, such feature may be combined with one or more other features of the other implementations as may be desired and advantageous for any given or particular application. Furthermore, to the extent that the terms "comprises" and "including" and variants thereof are used in either the detailed description or the claims, these terms are intended to be inclusive in a manner similar to the term "comprising."

The above descriptions of various embodiments of the subject disclosure and corresponding figures and what is described in the Abstract, are described herein for illustrative purposes, and are not intended to be exhaustive or to limit the disclosed embodiments to the precise forms disclosed. It is to be understood that one of ordinary skill in the art may recognize that other embodiments having modifications, permutations, combinations, and additions can be implemented for performing the same, similar, alternative, or substitute functions of the disclosed subject matter, and are therefore considered within the scope of this disclosure. Therefore, the disclosed subject matter should not be limited to any single embodiment described herein, but rather should be construed in breadth and scope in accordance with the claims below.

What is claimed is:

1. A system, comprising:

a processor; and a memory that stores executable instructions that, when executed by the processor, facilitate performance of operations, comprising:

generating an acoustic model for an area, wherein the acoustic model is associated with acoustic feedback and an interference, and wherein the acoustic model is generated based on a first location of a speaker in the defined area;

determining a second location of a mobile device in the area;

obtaining profile data representative of an audio profile of preference information of a user identity associated with the mobile device, wherein the preference information indicates a preference for an aural element of an audio playback of audio data; and generating an audio signal for the speaker based on the audio profile, the acoustic model, and a relative position of the mobile device from the speaker based on the first location of the speaker and the second location of the mobile device, wherein the audio signal being rendered by the speaker creates an aural experience at the second location that corresponds to the aural element of the audio playback.

2. The system of claim 1, wherein the aural element is associated with a sound source in the audio data.

3. The system of claim 2, wherein the aural element is a first aural element, and wherein the operations further comprise:

adjusting a volume of the first aural element relative to a second aural element different than the first aural element.

4. The system of claim 1, wherein the audio signal being rendered by the speaker creates the aural experience at the second location that corresponds to a sound environment of a virtual reality environment.

5. The system of claim 1, wherein the aural element is associated with mood preference information in the preference information representative of a mood to be applied to the audio signal.

6. The system of claim 1, wherein the generating the acoustic model for the area further comprises:

generating a baseline audio signal for the speaker; and analyzing an audio recording received by a microphone in response to the speaker producing sound based on the baseline audio signal.

7. The system of claim 6, wherein the operations further comprise:

estimating respective acoustic properties at a group of locations in the area, the group of locations comprising the first location and the second location.

8. The system of claim 1, wherein the operations further comprise:

tracking a movement of the mobile device in the area; and adjusting the audio signal based on the movement.

9. The system of claim 1, wherein the determining the second location further comprises:

determining the second location via at least one of Wi-Fi tracking, network location tracking, near field communication tracking or video tracking.

10. The system of claim 1, wherein the operations further comprise:

calibrating the acoustic model for the area based on an analysis of an image of the area.

11. A method, comprising:

determining, by a device comprising a processor, a first location of a mobile device in an area;

determining, by the device, a second location of a speaker in the area;

retrieving, by the device, an audio preference profile associated with the mobile device, wherein the audio preference profile comprises information associated with a sound preference to be applied to the speaker; and generating, by the device, an audio signal for the speaker based on a sound recording, wherein an acoustic element of the sound recording is adjusted based on the audio preference profile, an acoustic model of the area, and a relative position of the mobile device from the speaker based on the first location and the second location.

12. The method of claim 11, further comprising:

adjusting, by the device, a volume of the acoustic element relative to a different acoustic element in the sound recording.

13. The method of claim 11, further comprising:

matching, by the device, a sound at the first location to an audio environment in a virtual world environment.

14. The method of claim 11, wherein the determining the first location further comprises:

tracking the mobile device via at least one of Wi-Fi tracking, network location tracking, near field communication tracking or video tracking.

15. The method of claim 11, wherein the audio preference profile comprises mood preference information representative of a mood to be applied to the audio signal.

16. The method of claim 11, further comprising:

generating, by the device, a baseline audio signal for the speaker;

analyzing, by the device, an audio recording associated with the baseline audio signal; and determining, by the device, the acoustic model of the area based on a result of the analyzing.

17. The method of claim 11, further comprising:

tracking, by the device, a movement of the mobile device in the area; and adjusting, by the device, the audio signal based on the movement.

18. The method of claim 11, further comprising:

calibrating, by the device, the acoustic model for the area based on a result of analyzing an image captured of the area.

19. A machine-readable storage medium, comprising executable instructions that, when executed by a processor of a device, facilitate performance of operations, comprising:

determining a first location of a mobile device in an area;

determining a second location of a speaker in the area;

obtaining an audio preference profile associated with the mobile device, wherein the audio preference profile comprises information associated with a sound preference to be applied to sound output of the speaker; and generating an audio signal for the speaker based on a sound recording, wherein an acoustic element of the sound recording is adjusted based on the audio preference profile, an acoustic model of the area, and a relative position of the mobile device from the speaker based on the first location and the second location.

20. The machine-readable storage medium of claim 19, wherein the acoustic element is a first acoustic element, and wherein the operations further comprise:

based on the audio preference profile, adjusting a volume of the first acoustic element relative to a second acoustic element in the sound recording different than the first acoustic element.

* * * * *